US006076195A

United States Patent [19]

Klein

[11] Patent Number: 6,076,195

[45] Date of Patent: Jun. 20, 2000

[54] UNDERGARMENT

[76] Inventor: Karen Elizabeth Klein, 106 Byrd St., Belle Chasse, La. 70037

[21] Appl. No.: 09/299,732

[22] Filed: Apr. 27, 1999

[51] Int. Cl.[7] ..... A41B 9/00

[52] U.S. Cl. ..... 2/400; 2/406; 2/408; 2/403

[58] Field of Search ..... 2/400–408, 78.1, 2/227, 228, 238, 79, 455, 456, 466, 214, 215; 450/153; 604/396–398

[56] References Cited

U.S. PATENT DOCUMENTS

| | | | |
|---|---|---|---|
| 2,854,669 | 10/1958 | Cohen . | |
| 3,310,053 | 3/1967 | Greenwood | 450/153 |
| 3,871,030 | 3/1975 | Green . | |
| 4,035,844 | 7/1977 | Atack et al. | 2/227 |
| 4,533,355 | 8/1985 | Fair . | |
| 4,674,135 | 6/1987 | Greene . | |
| 4,811,427 | 3/1989 | Regan | 2/227 X |
| 5,067,178 | 11/1991 | Katchka . | |
| 5,093,935 | 3/1992 | Countee, Jr. . | |
| 5,134,726 | 8/1992 | Ross | 2/227 X |
| 5,165,115 | 11/1992 | Stanislaw . | |
| 5,172,430 | 12/1992 | Lerma-Solis . | |
| 5,243,974 | 9/1993 | Allen . | |
| 5,255,392 | 10/1993 | Stanislaw . | |
| 5,274,854 | 1/1994 | Wenner et al. | 2/403 |
| 5,819,323 | 10/1998 | Edenfield | 2/466 |
| 5,875,495 | 3/1999 | Thrower | 2/403 |
| 5,920,914 | 7/1999 | Dempsey | 2/403 |

*Primary Examiner*—Gloria M. Hale
*Attorney, Agent, or Firm*—Stephen R. Greiner

[57] ABSTRACT

An undergarment having front and rear portions attached together so as to define a waist opening in the top of the undergarment and a pair of leg openings in the opposite sides of the undergarment. A medial portion extends from the waist opening to a location between the leg openings. The medial portion has side and bottom edges attached to the front portion so as to define a pocket between the medial and front portions with a pocket opening in the top of the undergarment adjacent the waist opening. A bifurcated waistband has a circular, outer part which is attached to the front portion and the rear portion adjacent the waist opening. The waistband also has an inner part attached to the medial portion and the outer part.

1 Claim, 1 Drawing Sheet

UNDERGARMENT

FIELD OF THE INVENTION

The present invention relates generally to apparel and, more particularly, to underwear.

BACKGROUND OF THE INVENTION

Legless undershorts or briefs having pockets for concealing small items from the view of a casual observer have been proposed in the past. Despite having many benefits, briefs of this sort have not seen widespread use since, it is believed, the pocket openings have been difficult to locate beneath outer garments and the pocket closure mechanisms have made the briefs irritating to wear. A need, therefore, exists for a comfortable undergarment having at least one, easy-to-access pocket.

SUMMARY OF THE INVENTION

In light of the problems associated with the known briefs having pockets for carrying small items in a concealed manner, it is a principal object of the invention to provide an undergarment in the from of briefs which is both comfortable to wear and has one or more easily accessed pockets for toting: credit cards, a driver's license, keys, spare change and the like.

It is another object of the invention to provide an undergarment of the type described wherein the means for closing said pockets also serves to secure the undergarment to the waist of a user.

It is an object of the invention to provide improved elements and arrangements thereof in an undergarment for the purposes described which is lightweight in construction, inexpensive to manufacture, and dependable in use.

The undergarment in accordance with this invention achieves the intended objects by featuring front and rear portions attached together to define a waist opening and a pair of leg openings. A medial portion has a bottom edge sewn along a bottom seam and side edges sewn along lateral seams to the front portion to define a pocket with a pocket opening adjacent the waist opening. A bifurcated waistband has a circular, outer part attached to the front and rear portions adjacent the waist opening. The waistband also has an inner part attached to the medial portion. The ends of the inner part are attached to the outer part by the lateral seams. If desired, the medial portion can be attached to the front portion between the side edges thereof by at least one sewn seam to define a plurality of pockets between the medial and front portions with a corresponding plurality of pocket openings located adjacent the waist opening.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which.

Similar reference characters denote corresponding features consistently throughout the accompanying drawings.

DETAILED DESCRIPTION OF THE PREFERRED EMBODIMENT

Figure 1:
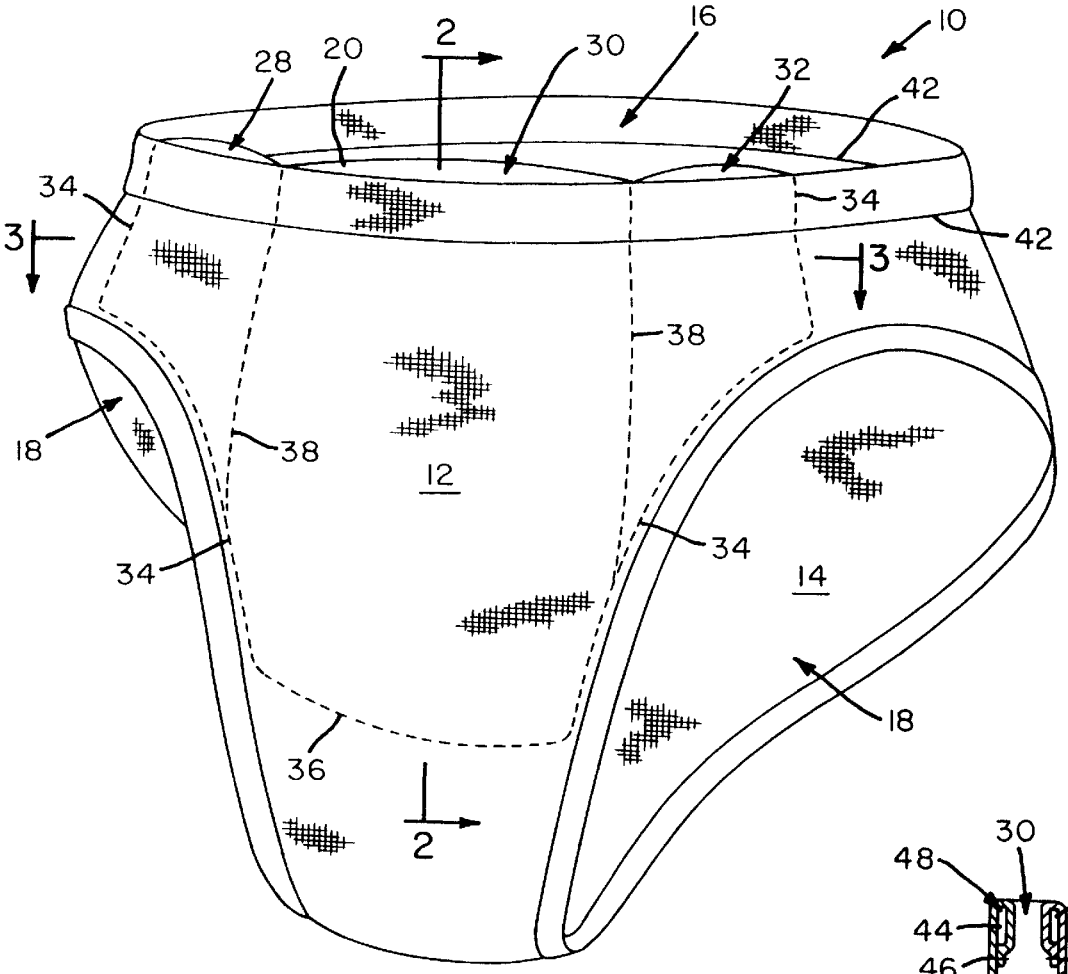
FIG. 1 is a perspective view of an undergarment in accordance with the present invention.
Figure 2:
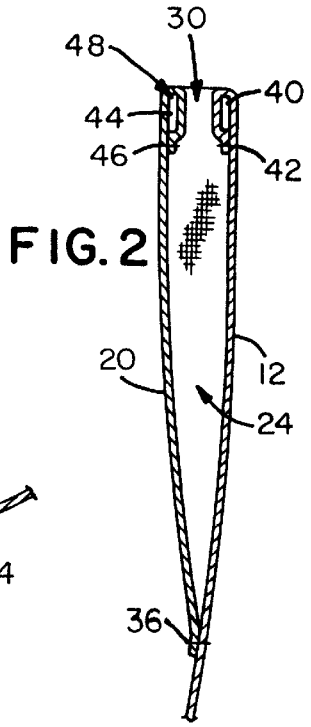
FIG. 2 is a cross-sectional view taken along line 2—2 of FIG. 1.
Figure 3:
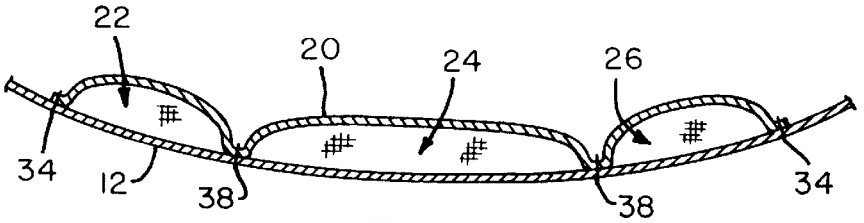
FIG. 3 is a cross-sectional view taken along line 3—3 of FIG. 1.

Referring now to the FIGS., an undergarment in accordance with the present invention is shown at 10. The undergarment 10 includes triangular, front and rear portions 12 and 14 which are joined together so as to define a waist opening 16 in the top of the undergarment and a pair of leg openings 18 in the opposite sides thereof. A medial portion 20 is positioned between front and rear portions 12 and 14 and is attached to front portion 12 to form pockets 22, 24 and 26 for carrying small items. The pockets 22, 24 and 26 have pocket openings 28, 30 and 32 adjacent waist opening 16 for easy access.

Medial portion 20 is sewn to front portion 12. Preferably, medial portion 20 is attached along its side edges to front portion 12 by sewn lateral seams 34 which extend for a part of their length along the edges of leg openings 18 and is also attached along its bottom edge to front portion 12 by sewn bottom seam 36 which extends between leg openings 18. A pair of laterally-spaced seams 38 extend upwardly from seams 34 and attach medial portion 20 to front portion 12 along two lines between the side edges of medial portion 20.

A bifurcated waistband 38, formed of an elastomeric material, is attached to front, rear and medial portions 12, 14 and 20. The band 38 includes a circular, outer part 40 to which the top edges of the front and rear portions 12 and 14 are attached by folding such over outer part 40 and then sewing a seam 42 to make a band-retaining sleeve. Waistband 38 also includes an inner part 44 to which the top edge of medial portion 20 is secured by forming a sleeve with the top edge of medial portion 20 and a sewn seam 46. Inner part 44 is attached in side-by-side fashion to outer part 40 at its ends and at intermediate points by seams 34 and 38.

The waistband 38 is sized to snugly encircle the waist of a wearer thereby placing the inner and outer parts 44 and 40 under a light tension. Tension serves to draw the inner and outer parts 44 and 40 together thereby closing the pocket openings 28, 30 and 32 and pressing inner part 44 against the wearer's waist. Because the inner and outer parts are positioned side-by-side, no uncomfortable creases, bunches or pulls arise in the fabric forming the front, rear and medial portions 12, 14 and 20 during wear.

Access to the contents of pockets 22, 24, 26 is obtained by either: pulling outwardly on outer part 40 of sleeved waistband 38, pulling inwardly on the sleeved inner part 44 thereof, or a combination of both. Since the pocket openings 28, 30 and 32 are adjacent waistband 38 a wearer need not remove an outer garment that opens at the waist to accomplish this task. Under all other circumstances, the undergarment 10 is donned, doffed and worn in the usual manner.

While the invention has been described with a high degree of particularity, it will be appreciated by those skilled in the art that modifications may be made thereto. For example, medial portion 20 could be positioned adjacent the outer surface of the front portion 12 rather than its inner surface as shown. Further, any number of spaced seams 38 could be used to form pockets in the undergarment. Therefore, it is to be understood that the present invention is not limited to the sole embodiment described above, but encompasses any and all embodiments within the scope of the following claims.

I claim:

1. An undergarment, comprising:

a triangular, front portion having three corners;

a triangular, rear portion also having three corners, said rear portion being attached at its corners to the corners of said front portion so as to define a waist opening and a pair of leg openings;

a medial portion extending from said waist opening to a location between said leg openings, said medial portion having a bottom edge sewn along a bottom seam to said front portion, said medial portion also having side edges sewn along lateral seams closely adjacent said leg openings to said front portion so as to define a pocket between said medial portion and said front portion with a pocket opening adjacent said waist opening, and said medial portion being attached to said front portion between the side edges thereof by at least one sewn seam so as to define a plurality of pockets between said medial portion and said front portion with a corresponding plurality of pocket openings adjacent said waist opening; and, a bifurcated waistband formed of an elastomeric material, said waistband having a circular outer part attached to said front portion and said rear portion adjacent said waist opening, said waistband also having an inner part attached to said medial portion, said inner part having opposed ends attached to said outer part by said lateral seams.

* * * * *